US007048055B2

(12) United States Patent
Hirth

(10) Patent No.: US 7,048,055 B2
(45) Date of Patent: May 23, 2006

(54) PACKER WITH INTEGRAL CLEANING DEVICE

(75) Inventor: David E. Hirth, Pasadena, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 122 days.

(21) Appl. No.: 10/386,162

(22) Filed: Mar. 10, 2003

(65) Prior Publication Data

US 2004/0177967 A1 Sep. 16, 2004

(51) Int. Cl.
*E21B 32/00* (2006.01)

(52) U.S. Cl. ..... 166/311; 166/118; 166/173

(58) Field of Classification Search ..... 166/311, 166/387, 118, 134, 173
See application file for complete search history.

(56) References Cited

U.S. PATENT DOCUMENTS

| | | | | | |
|---|---|---|---|---|---|
| 2,959,224 | A | * | 11/1960 | Ault | 166/311 |
| 4,359,000 | A | | 11/1982 | Tokunaga | |
| 4,548,265 | A | | 10/1985 | Luke | |
| 4,665,978 | A | | 5/1987 | Luke | |
| 4,732,211 | A | | 3/1988 | Haugen et al. | |
| 4,750,563 | A | | 6/1988 | Baugh | 166/382 |
| 4,762,177 | A | | 8/1988 | Smith, Jr. | 166/216 |
| 4,800,958 | A | | 1/1989 | Haugen et al. | |
| 4,825,954 | A | | 5/1989 | Baugh | 166/382 |
| 5,103,904 | A | | 4/1992 | Luke et al. | |
| 5,176,217 | A | | 1/1993 | Luke et al. | |
| 5,701,959 | A | * | 12/1997 | Hushbeck et al. | 166/387 |
| 6,009,943 | A | | 1/2000 | Yokley et al. | 166/125 |
| 6,012,523 | A | | 1/2000 | Campbell et al. | 166/277 |
| 6,460,617 | B1 | | 10/2002 | Allen | |
| 6,484,802 | B1 | | 11/2002 | McGarian et al. | |
| 6,547,002 | B1 | | 4/2003 | Bailey et al. | |
| 6,598,677 | B1 | | 7/2003 | Baugh et al. | 166/285 |
| 6,702,012 | B1 | | 3/2004 | Bailey et al. | |
| 2001/0040035 | A1 | * | 11/2001 | Appleton et al. | 166/387 |
| 2003/0132007 | A1 | * | 7/2003 | Howlett et al. | 166/387 |

FOREIGN PATENT DOCUMENTS

| | | |
|---|---|---|
| EP | 0 427 424 | 5/1991 |
| GB | 448083 | 6/1936 |
| GB | 2327963 | * 10/1999 |
| GB | 2 374 366 | 10/2003 |

OTHER PUBLICATIONS

Reciprocating Wellbore Wipers, Weatherford Cement Products Catalog.
U.K. Search Report, Application No. GB0405168.6, dated Jun. 10, 2004.

* cited by examiner

*Primary Examiner*—William Neuder
(74) *Attorney, Agent, or Firm*—Moser, Patterson & Sheridan, L.L.P.

(57) ABSTRACT

The present invention generally relates to methods and apparatus for sealing a tubular. In one embodiment, the apparatus includes a packer having a body, a sealing element, and a cleaning device operatively connected to the body. In one aspect, the apparatus may clean a surface of the tubular before the sealing element expanded into contact therewith.

29 Claims, 3 Drawing Sheets

PACKER WITH INTEGRAL CLEANING DEVICE

BACKGROUND OF THE INVENTION

1. Field of the Invention

The present invention relates to methods and apparatus for completing a well. Particularly, the present invention relates to an apparatus for cleaning an inner surface of a casing. More particularly, the present invention relates to a packer having a cleaning device for cleaning the inner surface of the casing.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps with the lower portion of the upper string of casing. The second "liner" string is then fixed or "hung" off of the upper surface casing. Afterwards, the liner is also cemented. This process is typically repeated with additional liner strings until the well has been drilled to total depth. In this manner, wells are typically formed with two or more strings of casing of an ever-decreasing diameter.

The process of hanging a liner off of a string of surface casing or other upper casing string involves the use of a liner hanger. In practice, the liner hanger is run into the wellbore above the liner string itself. The liner hanger is actuated once the liner is positioned at the appropriate depth within the wellbore. The liner hanger is typically set through actuation of slips which ride outwardly on cones in order to frictionally engage the surrounding string of casing. The liner hanger operates to suspend the liner from the casing string. However, it does not provide a fluid seal between the liner and the casing. Accordingly, it is desirable in many wellbore completions to also provide a packer.

During the wellbore completion process, the packer is run into the wellbore above the liner hanger. A threaded connection typically connects the bottom of the packer to the top of the liner hanger. Known packers employ a mechanical or hydraulic force in order to expand a packing element outwardly from the body of the packer into the annular region defined between the packer and the surrounding casing string. In addition, a cone is driven behind a tapered slip to force the slip into the surrounding casing wall and to prevent packer movement. Numerous arrangements have been derived in order to accomplish these results.

A problem associated with most conventional packer systems is the potential for the packer to leak. Generally, packers are designed to be installed on clean or smooth surfaces. Thus, it is desirable for the surrounding casing to have a clean contact surface for engagement with a packer. A packer installed on a casing having a dirty or rough surface may not initiate a seal or may become unseated over time because the dirty surface contains contaminants that affect the seal between the packer and the casing.

The contact surface of a surrounding casing in a wellbore typically contains deposits or contaminants left behind from the multitude of wellbore operations that are performed prior to the setting of the packer. For instance, cementing operations are commonly performed to fill the annular void between the casing and the formation. The cement is initially pumped down the inner diameter of the casing and pushed out and around the bottom of the casing. The cement slurry is typically followed by a wiper plug to wipe the cement from the inner surface of the casing. However, the wiping process is not totally efficient at high pump rates, and the fins of the wiper plug typically wear down during the process. As a result, a thin sheath of cement may be left on the inner surface of the casing. Additionally, the drilling mud used to displace the cement may also leave a layer of dehydrated solids on the inner surface.

Other sources of contaminants include the cuttings from the formation, debris from drilling out the wiper plug and the remaining cement in the inner diameter. These cuttings may remain in the casing if the circulating process is not efficient. In deviated or horizontal wells, any remaining cuttings may settle on the low side of the wellbore when the circulation is stopped. The cuttings may become embedded in the dehydrated solids on the casing wall.

Contaminants may also develop during the production of the casing. Casing is typically constructed from steel and steel alloys. The formation of the casing itself typically leaves behind a layer of oxidation products on the surface. The surface may form additional corrosion when it is exposed to moisture and oxygen. The corrosion process is accelerated when salt is present in the atmosphere, a condition often found in offshore drilling.

In summary, casing in the wellbore may have a multitude of contaminants on its inner surface. The contaminants may include oxidized products, corrosion, cuttings, cement, and dehydrated solids. These contaminants are generally somewhat porous, irregular in shape, or extrudable over time. As a result, the contaminants may compromise the sealing integrity of the packer.

Contaminants may be removed from the casing by performing a separate casing scraper run. However, scraper runs are generally not performed when running a liner in order to save time. Additionally, the time required to run a separate scraper run may cause the wellbore to fall in. Other methods of removing the contaminants include pumping spacer fluids or wash fluids in front of the cement to effect some cleaning action. However, fluid based cleaning methods are generally not as effective as mechanically based cleaning methods.

There is a need, therefore, for an apparatus for cleaning an inner surface of the casing. There is a further need for a packer having a cleaning device that cleans the inner surface of the casing without significantly adding to the time necessary for the wellbore operation. There is a further need for a method of cleaning the inner surface of the casing and setting the packer in one run.

SUMMARY OF THE INVENTION

The present invention generally relates to methods and apparatus for sealing between tubulars. In one embodiment, the apparatus includes a packer having a body, a sealing element, and a cleaning device operatively connected to the body. In one aspect, the apparatus may clean a surface of the tubular before the sealing element is expanded into contact therewith.

In another aspect, the present invention provides a method for sealing a tubular. The method includes providing a packer with a cleaning device, wherein the packer has a body and a sealing element. The packer and the cleaning device are positioned in the tubular. A surface of the tubular is cleaned using the cleaning device. After the surface has been cleaned, the sealing element is expanded against the cleaned surface of the tubular.

In another aspect still, a method for completing a wellbore includes placing a first tubular in an overlapping position with a second tubular. Thereafter, the first tubular is connected to the second tubular. While circulating cement through the first tubular, a surface of the second tubular may be cleaned using a cleaning device. Finally, a packer is actuated to expand a sealing element into contact with the cleaned surface. Preferably, the packer is operatively connected to the cleaning device. Moreover, the method may clean the tubular and the set the packer in a single run.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
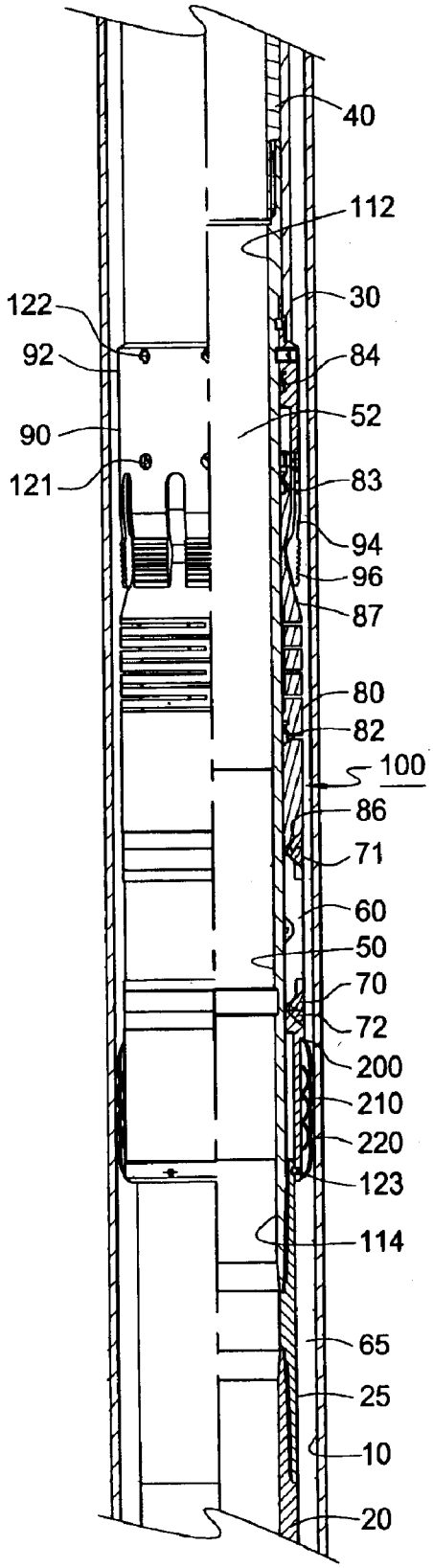
FIG. 1 illustrates a packer having a cleaning device disposed in a casing.

FIG. 1 presents a partial cross-sectional view of a packer 100 having a cleaning apparatus 200 in accordance with the present invention. The packer 100 has been run into a wellbore and positioned inside a string of casing 10. The packer 100 is designed to be actuated such that a seal is created between the packer 100 and the surrounding casing string 10.

The packer 100 is run into the wellbore at the upper end of a liner string or other tubular (not shown). Generally, the bottom end of the packer 100 is threadedly connected to a liner string using a liner hanger 20. As such, the packer is a liner top packer. However, aspects of the present invention are also applicable to a production packer or any suitable packer known to a person of ordinary skill in the art. Those of ordinary skill in the art will understand that the liner hanger 20 may be actuated in order to engage the surrounding string of casing 10 and, thereby anchoring the liner below. In this manner, a liner string may be suspended from the casing 10.

In the typical well completion operation, the packer 100 is run into the wellbore along with various other completion tools. For example, a polished bore receptacle 30 may be utilized with the packer 100. The top end of the packer 100 may be threadedly connected to the lower end of a polished bore receptacle, or PBR 30. The PBR 30 permits the operator to sealingly stab into the liner string with other tools. Commonly, the PBR 30 is used to later tie back to the surface with a string of production tubing. In this way, production fluids may be produced through the liner string, and upward to the surface.

The liner, liner hanger 20, PBR 30, and the packer 100 are run into the wellbore together on a landing string 40. A running tool (not shown) is commonly used to connect the landing string 40 to the liner and associated completion tools so that the packer 100 and connected liner may be run into the wellbore together. The associated completion tools may include tools for conducting cementing operations. For example, a cement wiper plug (not shown) may be run into the wellbore to cement the liner string into the formation as part of the completion operation.

Shown in FIG. 1 is a packer 100 comprising a mandrel 50. The mandrel 50 defines a tubular body that runs the length of the packer 100. As such, the mandrel 50 has a bore 52 therein which serves to provide fluid communication between the landing string 40 and the liner. This facilitates the injection and circulation of fluids during various wellbore completion and production procedures.

The mandrel 50 has a top end 112 and a bottom end 114. Generally, the top end 112 of the mandrel 50 is connected to a landing string 40, either directly or through an intermediate connection with a running tool. At the lower end 114, the mandrel 50 is connected to the liner (not shown), either directly or through an intermediate connection with the liner hanger 20. A coupling device 25 may be used to connect the packer 100 to the liner hanger 20.

As shown on FIG. 1, the packer 100 includes several components. The components may be fabricated from either metallic or non-metallic materials. In the preferred embodiment, the packer 100 includes a sealing element 60 that is capable of sealing an annulus 65 in harsh environments. Preferably, the sealing element 60 is made of a composite or elastomeric material and may have any number of configurations to effectively seal the annulus 65 within the casing 10. For example, the sealing element 60 may include grooves, ridges, indentations, or protrusions designed to allow the sealing element 60 to conform to variations in the shape of the interior of the surrounding casing 10.

Figure 2:
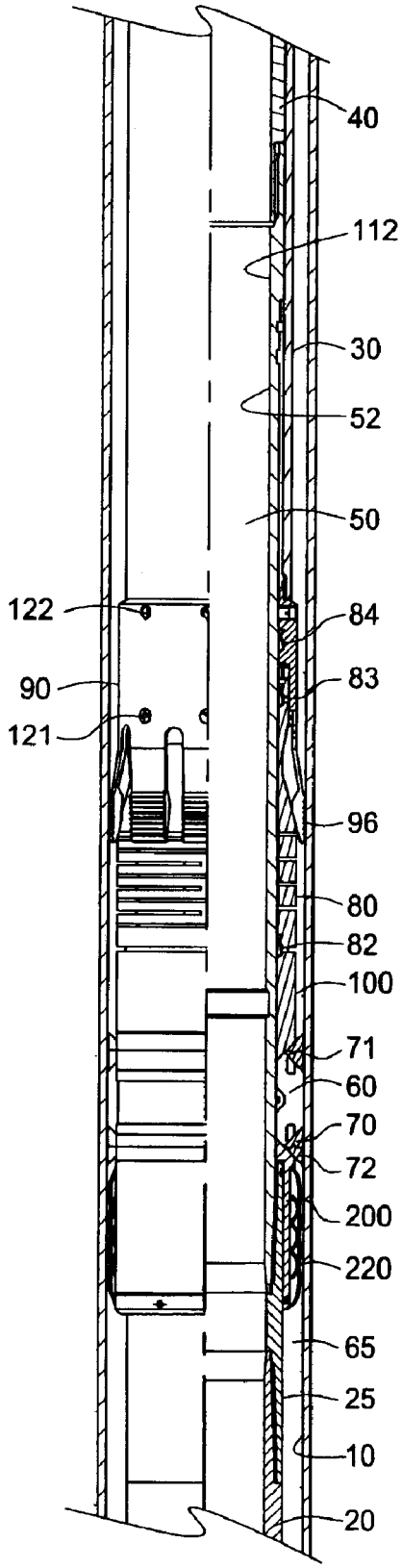
FIG. 2 illustrates the packer after actuation.

In one embodiment, the sealing element 60 resides circumferentially around the mandrel 50. The ends of the sealing element 60 may be designed to provide a ramp surface for other components of the packer 100. As will be disclosed below, the sealing element 60 is expanded into contact with the surrounding casing 10 in response to compressive forces transmitted by the PBR 30. In this way, the annular region 65 between the packer 100 and the casing 10 is fluidly sealed. FIG. 2 shows the packer 100 after expansion. As seen in FIG. 2, the expanded sealing element 60 contacts the surrounding casing 10 to provide a seal between packer 100 and the casing 10.

The packer 100 may include one or more backup rings 70 disposed adjacent each side of the sealing element 60. In one embodiment, two sets 71, 72 of backup rings 70 are used to support each side of the sealing element 60. Each set 71, 72 may include two backup rings 70 designed to expand toward the casing 10 upon actuation of the packer 100. Preferably, each backup ring 70 is an annular ring that may expand outward toward the casing 10 to facilitate the expansion of the sealing element 60. In this respect, the backup rings 70 may control the expansion of the sealing element 60.

The packer 100 may further include a cylindrical cone 80 disposed adjacent the upper set 71 of backup rings 70. Preferably, a lower end of the cone 80 has a ramp surface 86 that cooperates with the backup rings 70 to force the backup rings 70 outward into contact with the casing 10. An upper portion 87 of the cone 80 may be inclined to urge a slip member 90 outward. Upon actuation, the cone 80 may serve to transfer the axial force from the PBR 30 to the sealing element 60, thereby expanding the sealing element 60.

The cone 80 may also include one or more ratchet rings 82, 83 to limit the movement of the cone 80 relative to the mandrel 50. The ratchet rings 82, 83 may be disposed between the cone 80 and the mandrel 50. Preferably, each ratchet ring 82, 83 define a C-shaped circumferential ring around the outer surface of the mandrel 50. The ratchet rings 82, 83 include serrations that ride upon teeth formed on the outer surface of the mandrel 50. The ratchet rings 82, 83 are designed to provide one-way movement of the cone 80 with respect to the mandrel 50. Specifically, the ratchet rings 82, 83 are arranged so that the cone 80 may only move toward the sealing element 60. In this way, the cone 80 may be locked into position as it advances across the outer surface of the mandrel 50 toward the sealing element 50.

The packer 100 may further include one or more slip members 90. The slip members 90 may attach to the cone 80 using a first shearable member 121. An example of a shearable member 121 may include a shearable screw designed to shear at a predetermined force. The shearable member 121 prevents the accidental or premature setting of the slip member 90.

In one embodiment, each slip member 90 has a base portion 92, an arm portion 94, and a wicker portion 96 as illustrated in FIG. 1. The wicker portion 96 includes an outer surface having at least one outwardly extending serration or edged tooth to engage the casing 10. An inner surface of the slip portion 96 may be tapered to complement the outer surface 87 of the cone 80. The arm portion 94 is designed to provide flexibility between the wicker portion 96 and the base portion 92. In this respect, the wicker portion 96 is urged outward as it slides along the incline of the cone 80 while the base portion 92 remains in contact with the mandrel 50. The base portion 92 may include one or more ratchet rings 84 to provide one-way movement of the slip member 90 relative to the mandrel 50.

The wicker portion 96 may be selectively attached to the mandrel 50 using a second shearable member 122. The shearable connection prevents the accidental or premature setting of the packer 100 during run-in of the packer 100 into the wellbore. Preferably, the second shearable member 122 shears at a lower shearing force than the first shearable member 121 in order to control the setting sequence of the packer 100. This allows the slip member 90 and the cone 80 to move along the mandrel 50 and apply an axial force to the sealing element 60 before the slip portion 96 is expanded toward the casing 10. Once the sealing element 60 has been expanded, the wicker portion 96 may be actuated to support the expanded sealing element 60 in the casing 10.

In another aspect, the packer 100 may include a cleaning device 200 to clean an inner surface of the casing 10. As shown in FIG. 1, the cleaning device 200 is disposed adjacent the lower set 72 of backup rings 70. A lower end of the cleaning device 200 may be attached to the coupling device 25 using a third shearable member 123. Preferably, the third shearable member 123 shears at the same force as the second shearable member 122.

The cleaning device 200 may include a cylindrical body 210 and one or more wipers 220. The cylindrical body 210 may have two inner surfaces of different inner diameters such that one end of the cylinder body 210 contacts the mandrel 50 and the other end of the cylinder body 210 contacts the coupling device 25. Preferably, the inner surface contacting the coupling device 25 extends along a length of the cylinder body 210 such that a portion of the cylinder body 210 may slide over a portion of the coupling device 25. Although the cleaning device 200 is shown attached to the coupling device 25, it is contemplated that the cleaning device 200 may be directly attached to the liner hanger 20 or liner.

Figure 3:
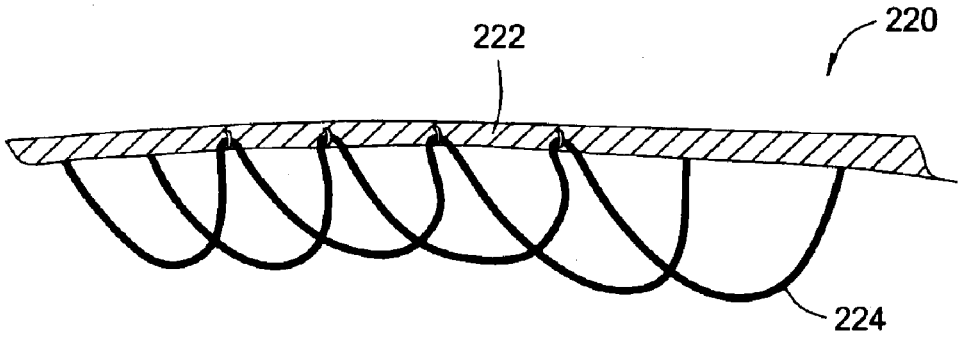
FIG. 3 illustrates a wiper applicable to aspects of the present invention.

One or more wipers 220 may be circumferentially spaced on an outer surface of the cylinder body 210. In one embodiment, each wiper 220 defines a strip 222 of wipers having wire cables 224 disposed along the length of the strip 222 as shown in FIG. 3. Preferably, the wire cables 224 are disposed on the strip 222 such that one or more arches are formed on the strip 222. The wipers 220 may be rotated to clean an inner surface of the casing 10. As the wipers 220 are rotated, the wire cables 224 engage the casing 10 and remove contaminants or deposits on the inner surface. It must be noted that aspects of the present invention are not limited to the wire cable wipers, but include other types of cleaning device known to a person of ordinary skill, such as spring loaded casing scrapers and brushes.

The packer 100 of the present invention is set through mechanical forces, hydraulic forces, or combinations thereof. The mechanical force to be applied on the packer 100 for setting may be derived from the landing string 40. In operation, the liner and associated completion tools, including the packer 100 and the liner hanger 20, are positioned within the wellbore. The liner is then set through actuation of the rotating liner hanger 20. Once set, the landing string 40 may be rotated to rotate the packer 100 with respect to the casing 10. In turn, the cleaning device 200 is rotated to clean an inner surface of the casing 10. Because the liner is typically rotated during cementing operations, the cleaning device 200 may be rotated at the same. In this respect, the aspects of the present invention advantageously allow the casing 10 to be cleaned as part of the cementing operation, thereby cleaning the casing 10 in a time and cost saving manner. After a proper volume of cement slurry has been circulated or a sufficient amount of cleaning has been achieved, the packer 100 may be set.

To set the packer 100, the landing string 40 is disengaged from the liner and pulled up a distance within the wellbore. Spring-loaded dogs (not shown) positioned in the landing string 40 are raised within the wellbore so as to clear the top of the PBR 30, whereupon the dogs spring outward. The landing string 40 then uses the dogs in order to land on top of the PBR 30, and to exert the force needed to begin actuation of the packer 100. In this regard, the suspended weight of the landing string 40 is slacked off from the surface so as to apply gravitational force downward on the PBR 30, and, in turn, the slip member 90.

The packer 100 is constructed and arranged to transmit a downward force through the slip member 90 to the sealing element 60. With the mandrel 50 held stationary, sufficient force is applied to cause shearing of the second and third shearable members 122, 123, thereby allowing the outer components of the packer 100, such as the slip member 90, cone 80, backup rings 70, sealing element 60, and the cleaning device 200, to move relative to the mandrel 50. In this respect, the cleaning device 200 is caused to move along mandrel 50 and over the coupling device 25. In this manner, the sealing element 60 is moved to a position previously occupied by the cleaning device 200 and adjacent to the cleaned portion of the casing 10.

As shown in FIG. 2, the cleaning device 200 may move along the mandrel 50 until it presses against the coupling device 25. At this point, the continued application of the setting force compresses the sealing element 60 and the backup rings 70 between the cleaning device 200 and the cone 80. In turn, the backup rings 70 are urged outward toward the casing 10. Additionally, the sealing element 60 begins to expand radially to form a seal with the casing 10. The backup rings 70 may serve to contain and direct the expansion of the sealing element 60 toward the cleaned portion of the casing 10. As the cone 80 moves towards the sealing element 60, the ratchet rings 82, 83 of the cone 80 also move along the mandrel 50 and prevent the cone 80 from reversing directions.

When the sealing element 60 is substantially expanded, additional setting force is applied to shear the first shearable member 121 connecting the slip member 90 to the cone 80. This allows the slip member 90 to move closer to the cone 80, thereby causing the wicker portion 96 to ride along the inclined portion of the cone 80. In turn, the wicker portion 96 is forced outward toward the casing 10 for engagement therewith. In the set position shown in FIG. 2, the slip member 90 is wedged between the cone 80 and the casing 10. As a result, slip member 90 assists in maintaining the seal formed when the setting force is removed. Furthermore, the ratchet ring 84 of the slip member 90 prevent the slip member 90 from reversing directions. In this manner, aspects of the present invention provide a method for setting a packer 100 against a cleaned portion of the casing 10 in a single run.

In another aspect, the cleaning device 200 may include vanes attached to its outer surfaces. The vanes are designed to rotate the cleaning device 200 relative to the casing when flow is induced across the vanes. The flow induced rotation may provide the cleaning action without rotation of the landing string 40 or liner. When set, the liner hanger 20 may centralize the cleaning device to prevent binding of the vanes will the wellbore. In operation, the normal annular velocities of the cement and the displacement fluid during the cementing operation may provide the force necessary to rotate the cleaning device 200.

Figure 4:
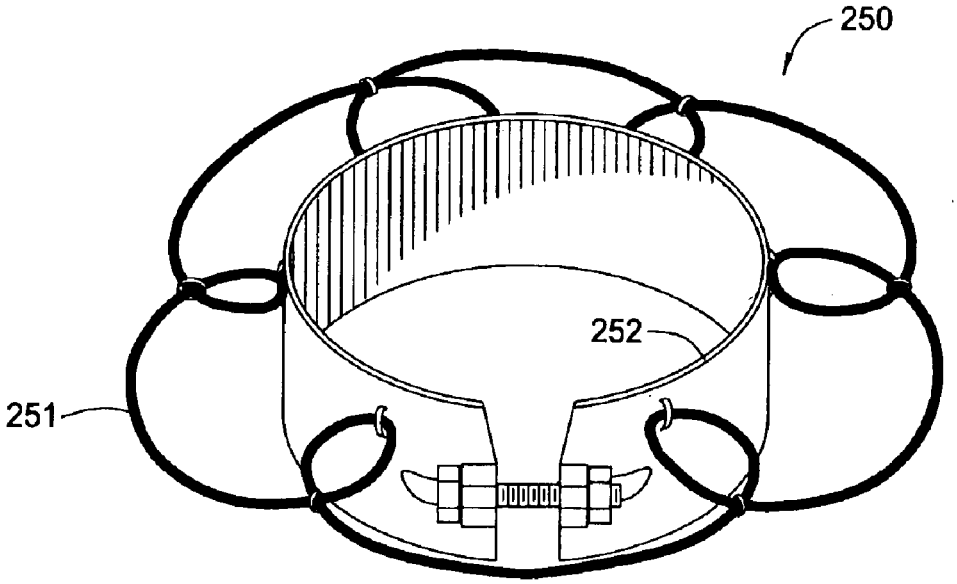
FIG. 4 illustrates another wiper applicable to aspects of the present invention

In another aspect, the landing string 40 may be reciprocated, instead of rotated, to clean the casing 10. In this respect, the cleaning device 200 may be designed and adapted to effect cleaning of the casing 10 by raising and lowering the landing string 40. In one example, the cleaning device 200 may include reciprocating wellbore wipers 250 as shown in FIG. 4. Reciprocating wipers 250 may include a continuous, interlocking and overlapping loop of wire cable 251 laced into a collar 252. When the liner/landing string 40 is raised and lowered, the wipers 250 produce a wiping action to remove contaminants or deposits from the casing 10.

While the foregoing is directed to embodiments of the present invention, other and further embodiments of the invention may be devised without departing from the basic scope thereof, and the scope thereof is determined by the claims that follow.

I claim:

1. A packer, comprising:

a body;

a sealing element disposed about the body; and a cleaning device selectively connected to the body, wherein the sealing element and the cleaning device are axially movable relative to the body and wherein the sealing element is substantially moveable to where the cleaning device was originally disposed.

2. The packer of claim 1, wherein the cleaning device is selected from the group consisting of a wiper, a brush, and a scraper.

3. The packer of claim 1, wherein the cleaning device is rotated to clean a surface of a casing.

4. The packer of claim 3, wherein the sealing element is expanded against the cleaned surface.

5. The packer of claim 1, wherein the cleaning device is reciprocated to clean a surface of a casing.

6. The packer of claim 1, wherein the cleaning device comprises a wiper having a wire cable.

7. The packer of claim 1, further comprising one or more backup rings disposed adjacent to the sealing element.

8. The packer of claim 7, further comprising a cone disposed adjacent to the one or more backup rings.

9. The packer of claim 8, further comprising a slip member disposed adjacent to the cone.

10. The packer of claim 9, wherein the slip member is selectively attached to the cone.

11. The packer of claim 9, wherein the slip member is selectively attached to the body.

12. The packer of claim 9, further comprising one or more ratchet rings.

13. The packer of claim 7, further comprising a cone disposed adjacent to the one or more backup rings.

14. The packer of claim 13, further comprising a slip member disposed adjacent to the cone.

15. The packer of claim 14, wherein the slip member is selectively attached to the body.

16. The packer of claim 1, wherein the cleaning device comprises one or more vanes for rotating the cleaning device.

17. A method for completing a wellbore, comprising:

providing a first tubular connected to a packer, the packer having a sealing element and a cleaning device;

placing the first tubular in an overlapping position with a second tubular;

connecting the first tubular to the second tubular;

circulating cement through the first tubular and the second tubular;

cleaning a surface of the second tubular using the cleaning device; and actuating the packer to expand the sealing element into contact with the cleaned surface; thereby sealingly connect the first tubular to the second tubular.

18. The method of claim 17, wherein the surface is cleaned and the packer is actuated in a single run.

19. The method of claim 17, wherein the packer is operatively connected to the cleaning device.

20. The method of claim 17, wherein cleaning device is rotated to effect cleaning of the second tubular.

21. The method of claim 17, wherein the cleaning device is actuated by the circulating cement.

22. The method of claim 17, wherein the cleaning device is reciprocated to effect cleaning of the second tubular.

23. The method of claim 17, wherein a liner hanger is actuated to connect the first tubular to the second tubular.

24. The method of claim 17, further comprising applying a force to actuate the packer.

25. The method of claim 23, further comprising moving the sealing element adjacent to the cleaned surface of the second tubular.

26. A method for completing a wellbore, comprising:

placing a first tubular in an overlapping position with a second tubular;

connecting the first tubular to the second tubular;

circulating cement through the first tubular;

cleaning a surface of the second tubular using a cleaning device, wherein the cleaning device is actuated by the circulating cement; and actuating a packer to expand a sealing element into contact with the cleaned surface.

27. A method for completing a wellbore, comprising:

placing a first tubular in an overlapping position with a second tubular;

actuating a liner hanger to connect the first tubular to the second tubular;

circulating cement through the first tubular;

cleaning a surface of the second tubular using a cleaning device; and actuating a packer to expand a sealing element into contact with the cleaned surface.

28. The method of claim 17, wherein the first tubular and the second tubular comprises a liner.

29. A packer, comprising:

a body;

a sealing element disposed about the body; and a cleaning device selectively connected to the body, wherein the sealing element and the cleaning device are axially movable relative to the body end wherein the cleaning device comprises one or more vanes for rotating the cleaning device.

* * * * *